US006522304B2

(12) United States Patent
Ballantine et al.

(10) Patent No.: US 6,522,304 B2
(45) Date of Patent: Feb. 18, 2003

(54) DUAL DAMASCENE HORN ANTENNA

(75) Inventors: Arne Watson Ballantine, Round Lake, NY (US); Daniel Charles Edelstein, White Plains, NY (US); James Spiros Nakos, Essex Junction, VT (US); Anthony Kendall Stamper, Williston, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/832,557

(22) Filed: Apr. 11, 2001

(65) Prior Publication Data

US 2002/0149530 A1 Oct. 17, 2002

(51) Int. Cl.[7] ..... H01Q 13/00
(52) U.S. Cl. ..... 343/772; 343/770
(58) Field of Search ..... 343/770, 767, 343/761, 795, 772, 762, 786; H01Q 13/00

(56) References Cited

U.S. PATENT DOCUMENTS

| | | | | | |
|---|---|---|---|---|---|
| 4,052,724 | A | * | 10/1977 | Taketchi et al. | 343/786 |
| 4,575,631 | A | | 3/1986 | Satchell | 250/332 |
| 4,757,324 | A | * | 7/1988 | Dhanjal | 343/776 |
| 4,888,597 | A | | 12/1989 | Rebiez et al. | 343/778 |
| 4,994,819 | A | * | 2/1991 | Noerpel | 343/786 |
| 5,142,595 | A | * | 8/1992 | Chester | 385/37 |
| 5,258,768 | A | * | 11/1993 | Smith | 343/786 |
| 5,363,105 | A | | 11/1994 | Ono et al. | 342/20 |
| 5,426,442 | A | * | 6/1995 | Haas | 343/778 |
| 5,440,279 | A | * | 8/1995 | Kinoshita et al. | 333/128 |
| 5,657,033 | A | | 8/1997 | Young | 343/786 |
| 5,818,984 | A | | 10/1998 | Ahmad et al. | 385/14 |
| 5,883,604 | A | | 3/1999 | Nicely | 343/786 |
| 6,037,258 | A | * | 3/2000 | Liu et al. | 438/687 |
| 6,049,313 | A | | 4/2000 | Sawada et al. | 343/786 |
| 6,156,642 | A | * | 12/2000 | Wu et al. | 438/637 |
| 6,198,456 | B1 | * | 3/2001 | Le Halle et al. | |
| 6,271,799 | B1 | * | 8/2001 | Rief et al. | 343/776 |

FOREIGN PATENT DOCUMENTS

WO WO 98/43314 10/1998

OTHER PUBLICATIONS

Brian Floyd et al., Wireless Interconnection in a CMOS IC with Integrated Antennas, Digest of Technical Papers, 2000, pp. 328–331.

Steinbruchel, "Patterning of Copper For Multilevel Metallization: Reactive Ion Etching and Chemical–Mechanical Polishing", Applied Surface Science 91, 1995, pp. 139–146.

* cited by examiner

*Primary Examiner*—Don Wong
*Assistant Examiner*—Trinh Vo Dinh
(74) *Attorney, Agent, or Firm*—Todd M. Li; McGinn & Gibb PLLC

(57) ABSTRACT

An integrated horn antenna device with an integrated circuit (IC) chip including a metallic horn structure having a wide aperture, a horizontal waveguide with a tapered via that electromagnetically communicates with a vertical waveguide structure to transmit energy to and from an electronic sub-component transceiver device forming part of the IC chip. Another embodiment of the invention comprises a plurality of multiple discrete IC chips having the integrated horn antenna devices incorporated therewith forming a module for data transmissions between these IC chips. Another embodiment of the invention includes additional external waveguide structures such as optical fibers external to the chips, where radiation is aligned between the horn structures and these waveguides. Dual damascene processing is used to fabricate the horn antenna device within the IC chip.

13 Claims, 4 Drawing Sheets

DUAL DAMASCENE HORN ANTENNA

BACKGROUND OF THE INVENTION

1. Field of the Invention

The present invention generally relates to antenna structures used with integrated circuits (IC), and particularly to a horn antenna that is integrated with waveguides and other components, which is made by a dual damascene technique.

2. Description of the Related Art

Electromagnetic(EM) waveguides (including antennae) are structures that confine and guide EM energy from one physical location to another. A hollow EM waveguide is typically a conductive tube-like structure, wherein a horn antenna is a tapered or flared structure that couples energy to or from free space and concentrates the energy within a defined beam pattern. Only the inside structure of these antenna devices need be conductive so as allow current within a skin depth of the metallic surface, which is related to wavelength of the transmitted energy. Dimensions of these structure are also dependent on characteristic wavelength of radiation transmitted through these structures. Thus, at wavelengths less than a microwave range, structures are less than a millimeter in dimension and special fabrication techniques must be used.

Horn antennae are widely used in broadband radio frequency (RF) and microwave signal transmitter/receiver applications where high-power, high-gain and high-efficiency capabilities are required. The metallic horn is essentially a short, broadband waveguide that greatly increases EM energy efficiency in collection or transmission, by concentrating the full 3-D radiation pattern into a smaller directed solid angle pattern. Since the horn is relatively short (compared to a hollow waveguide), collection of evanescent waves is possible with characteristic wavelengths that are much larger than the horn size, which partially penetrate into the horn. This phenomenon is similar to the way a stethoscope collects sound waves that typically have much larger wavelengths.

An example of a horn antenna devices formed on an IC chip includes PCT WO 98/43314A1 entitled "Integration of Hollow Waveguides, Channels, and Horns by Lithographic and Etching Techniques," which discloses ways of constructing horn antennae using standard IC techniques. However, for very high-frequency digital computing applications that typically require high bandwidth, for massively parallel core communication capabilities, as well as for emerging broadband and mixed analog/digital integrated chips and systems, a need exists for an integration process and integrated horn antenna structure within an IC chip. There is a need for such an integrated horn antenna to be made with a process that is less expensive than the existing discrete devices, where the antenna structure can be fabricated within high performance multilayered on-chip wiring, using damascene wiring and interconnect structures. These techniques avoid the bandwidth limitations imposed by parasitic impedances, and the concomitant impedance-matching and packaging complexities, associated with off-chip signal propagation on metal interconnects when discrete waveguide structures are used.

SUMMARY OF THE INVENTION

It is, therefore, a primary object of the present invention to provide a horn antenna device and method for making same in an integrated circuit (IC) using a dual damascene process that overcomes the problems as stated above.

Another object of the present invention is to provide a horn antenna array formed of multiple antennae on multiple discrete IC chips in a module for transceiver capabilities between these each of these IC chips.

Another object of the invention is to provide an integrated horn antenna device having an integrated waveguide structure that is simultaneously fabricated with multi-layered wiring interconnects using a dual damascene process.

Another object of the invention is to provide a means for further guiding the electromagnetic radiation being transmitted or received by the IC horn antennae by providing additional dielectric or conductive waveguides placed on the package or printed circuit board that the IC is connected to, in such a manner that the IC horn antennae are aligned to the additional waveguides.

The invention provides an integrated horn antenna device within an IC chip for transmitting or receiving electromagnetic energy across the same IC chip or between discrete and independent IC chips on a multi-chip module, chip carrier, or printed circuit board. The dimensions of the antenna device permit transmissions of electromagnetic radiation signals at radio, microwave, or optical frequencies. Applications of the invention include integration with IC-chips having transceiver electronic sub-components that cooperatively function with either digital or analog circuits. Use of the invention in a multi-IC chip module results in higher isolation efficiency and lower noise levels, which digital computing and low-noise analog communication networks now require. The horn antenna device provides an efficient light collector when optical light is used.

This invention transforms the mode of chip-to-chip, chip-to-package, or chip-to-free space communication from using multilayer interconnects on a complex, high-performance package to using free-space electromagnetic radiation signals, i.e. to "wireless" communication. This transformation thus allows the simplification and cost reduction of the type of package used for the IC chips in a complex system.

The antenna device is concurrently fabricated with wiring and interconnect structures using multilevel dual-damascene processing with copper on-chip interconnects preferably used. Use of damascene processing of IC chips incurs lower-production costs since comparable discrete components typically require more processing steps.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1A:
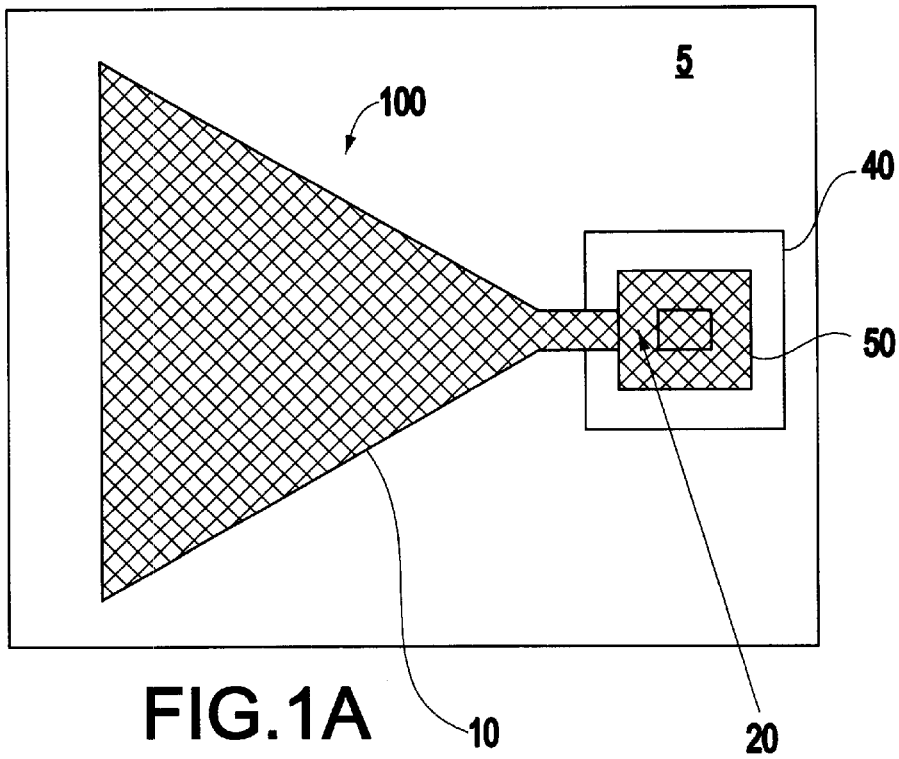
FIGS. 1*a,* 1*b* and 1*c* show a top view, a side view and front cross-sectional view of the horn antenna device respectively.
Figure 1B:
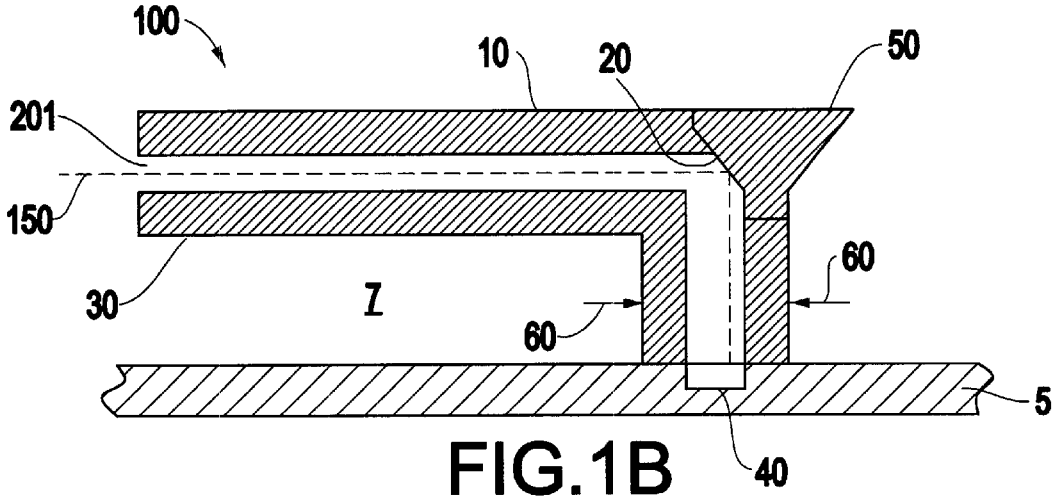
Figure 1C:
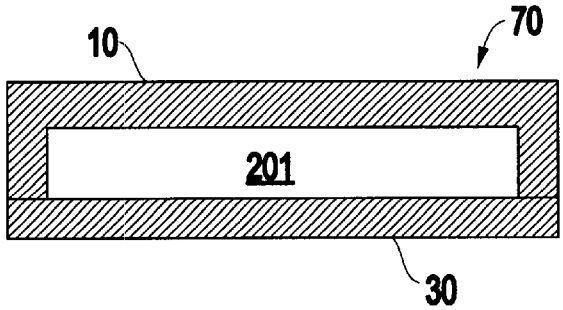

Referring now to FIGS. 1*a,* 1*b* and 1*c,* a horn antenna device 100 is shown. This device is used for chip-to-chip communications using RF, microwave, infrared, or visible EM spectral bands. The device can be either a stand-alone structure or form part of an array that are mounted on chip-edges (see below and shown in FIG. 3), wherein each horn antenna device is part of a multiple transceiver network on a common module. A sequence of dual damascene fabrication steps are shown in FIGS. 2*a* and 2*b* of the horn antenna device that is made concurrently with the wiring/interconnects on an IC chip.

FIGS. 1*a,* 1*b* and 1*c* show a top, side, and frontal-views of an exemplary form of the device 100. An upper sectional horn antenna structure 10 and a bottom horn sectional structure 30 together formed using metal damascene construction form a horizontal waveguide section 70 having a tapered via 50, preferably with a 45-degree tapered opening section. This waveguide section 70 in turn communicates with an integrally formed vertical waveguide section 60 that is axially normal to section 70 (e.g. has a 90-degree offset as shown, but can be of differing angularity as required for intended use). Using the damascene processing as discussed below allows for this 90-degree deflection of radiation 150 through the metallized tapered via structure 50 to a transceiver component 40, such as a photodetector device located in or on the chip, thereby enabling the channeling of collected radiation 150. The tapered via structure 50 reflects incoming and outgoing EM signals 150 to and from the device. The vertical waveguide section 60 in turn communicates with an electronic sub-component 40 (transceiver device 40 that is either electronically active or passive) that is attached and forms part of the IC chip substrate 5. A facet 20 at the apex of the horn antenna can be incorporated for reflecting radiation 150 within the waveguide structures. The waveguide sections 60, 70 are constructed using dual-damascene processing as discussed below. EM energy 150 is transmitted towards and reflected from the tapered via 50 (wide aperture of horn antenna provides higher coupling efficiency) by reflections from metallized sidewalls forming the vertical and horizontal waveguide sections 60, 70 respectively.

Figures 2A, 2B:
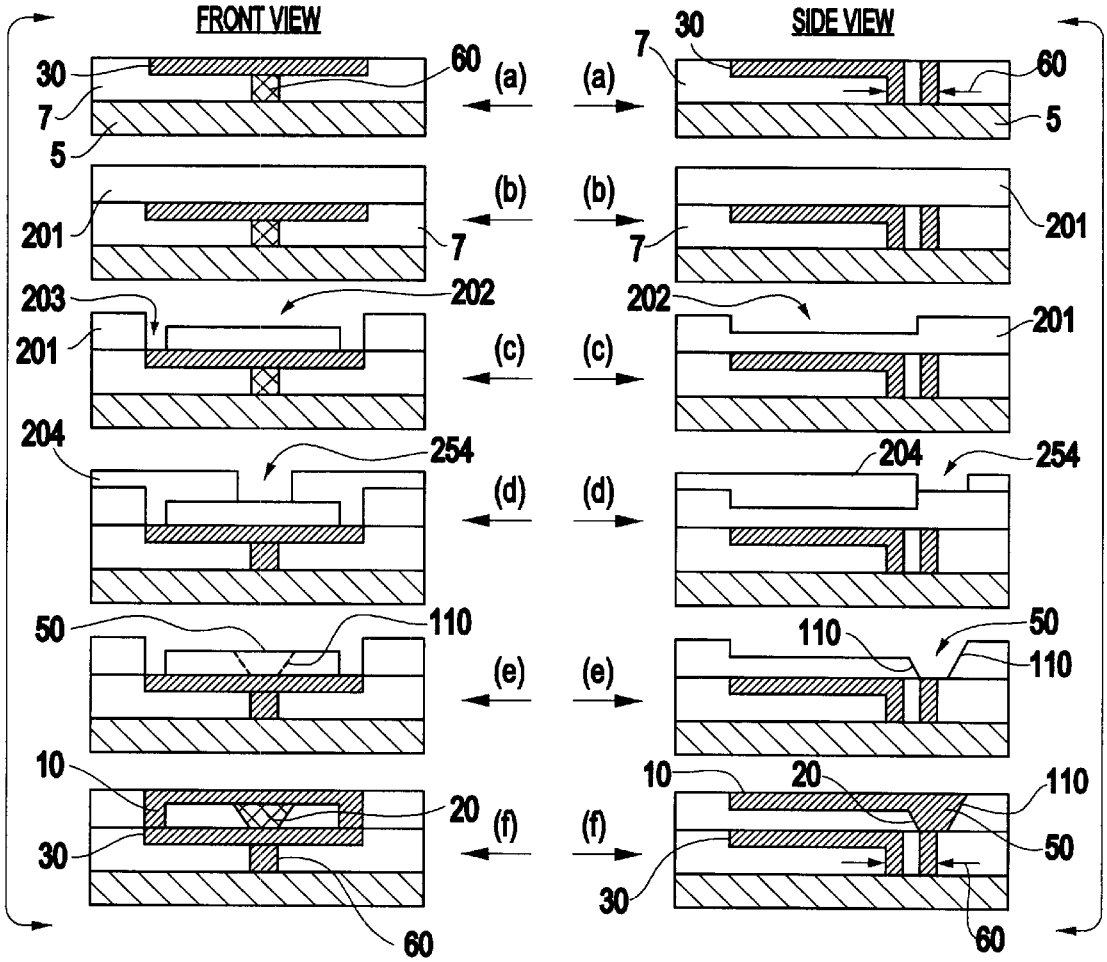
FIGS. 2*a* and 2*b* show a side and front cross-sectional views of a sequence of steps showing how the horn antenna device is made.

FIGS. 2A and 2B show the processing steps to fabricate the horn antenna device 100 that can be interconnected with fine wires and connect structures using damascene processing of copper lines and copper filled vias on an IC chip 5. This form of chip wiring allows for greater operational bandwidth capabilities of an IC chip since parasitic impedances and impedance mismatches at interconnections of components on an IC chip are minimized when using this technique. Conventional discrete IC chips generally use aluminum wiring only, which incurs substantial limited performance when compared to IC ships that use copper damascene wiring/interconnections. In CMOS technologies, use of copper damascene fabricated IC chips is less expensive to use and has better conductivity and electromigration resistance when compared to aluminum wiring. Although copper is the preferred metal of use in the dual damascene processing, other high-conductivity metals (such as aluminum, gold, or silver) are also within the scope of this invention. Use of copper damascene structures can form multilevel conductive wire/contact structures having feature sizes in the range of 0.5 microns or less. To obtain a damascene structure such as shown in step (a) of FIGS. 2A and 2B, typical processing steps for these structures include blanket deposition of a dielectric material 7, 201; patterning of the dielectric material 7, 201 to form line trenches and via openings; deposition of a diffusion barrier layer (not shown) and, optionally, a wetting layer (not shown) to line the trenches and/or openings; deposition of a copper layer 60, 30 onto the substrate in sufficient thickness to fill the trenches and openings by either physical vapor deposition (PVD), chemical vapor deposition (CVD), or by electroplating; and removal of excessive conductive material from the substrate surface. Excess conductive material is typically removed using chemical-mechanical polishing (CMP) techniques. Damascene processing of structures is described in detail by Steinbruchel in "Patterning of copper for multilevel metallization: reactive ion etching and chemical-mechanical polishing," *Applied Surface Science* 91, pages 139–146 (1995). Also see U.S. Pat. Nos. 6,037,258 and 6,156,642.

In FIGS. 2*a* and 2*b,* the dual damascene horn device formation is shown starting at an intermediate stage, where the vertical waveguide structure 60 and the lower plate 30 of the antenna as well as additional same-level interconnects (not shown for clarity) have already been formed. The IC chip structure 5 in step (a) is provided and can be built up to a preliminary level, where typically either complimentary or bi-complimentary metal oxide silicon transistors as well as bipolar junction transistors may be included. Local damascene interconnects at lower levels (not shown for clarity) are previously formed prior to construction of the antenna horn device 100 and are processed during initial formation of the antenna device on the IC chip substrate 5. The foregoing layers can be formed using any conventional process, such as chemical vapor deposition (CVD), sputtering, evaporation, etc.

At step (b), an interlevel dielectric layer (ILD) 201, typically silicon dioxide or low-dielectric constant insulator, is deposited, typically by plasma-enhanced chemical vapor deposition, or spin-apply and cure. Next at step (c), the line-level 202 and via-level 203 openings are defined by photolithography and subsequent reactive-ion etching (RIE).

At step (d) a mask 204 is formed (for example, using a photoresist material. Mask 204 is patterned to define a photoresist via opening 254, and then a RIE process (described in more detail below) is performed to create tapered via opening 50 and then the mask 204 is stripped. These openings 202, 203 and 50 are then filled with refractory metal liner, seed layer, and electroplated copper 10, and the metal overburden is removed in a planar fashion by chemical-mechanical polishing (CMP), resulting in the structure shown in step (f). Steps (a) through (f) may be used to form multiple layers of the horn cavity structure 10, 30, concurrently with multiple line and via level interconnects. In steps (d) through (e), the tapered via 50 is formed separately from the normal (vertical-walled) vias 60 forming the vertical waveguide structure 60. Typically the RIE process parameters as to pressure, power, or chemistry are altered so that the tapered sidewalls 110 are formed. The preferred sidewall angle is 45 degrees. For example, if a slight amount of oxygen is added to the RIE gases, the photoresist via opening 254 will gradually expand while the via 50 is etched; this exposes the upper portions of the via 50 in an ever-widening photoresist opening 254, with the result that the via size will grow uniformly wider towards the top. Conversely, a strongly polymerizing RIE chemistry (such as by the addition of fluorocarbon and fluorohydrocarbon gases) gradually closes the opening, leading to a via that shrinks uniformly smaller the deeper it gets. Either way, a strongly and uniformly tapered via sidewall 110 may be formed as a facet 20 at the apex of the horn antenna.

Other vertical vias may also be formed, in a separate mask and RIE sequence, on the same level. After the line level is formed, the patterns are filled as before with liner/seed plated copper and then planarized by CMP to form the final horn shape as it appears in step (f). The chip may then be finished (not shown) with upper wiring layers, conventional dielectric passivation, terminal metals (wirebond or C4 solder balls), and packaging.

Figure 3:
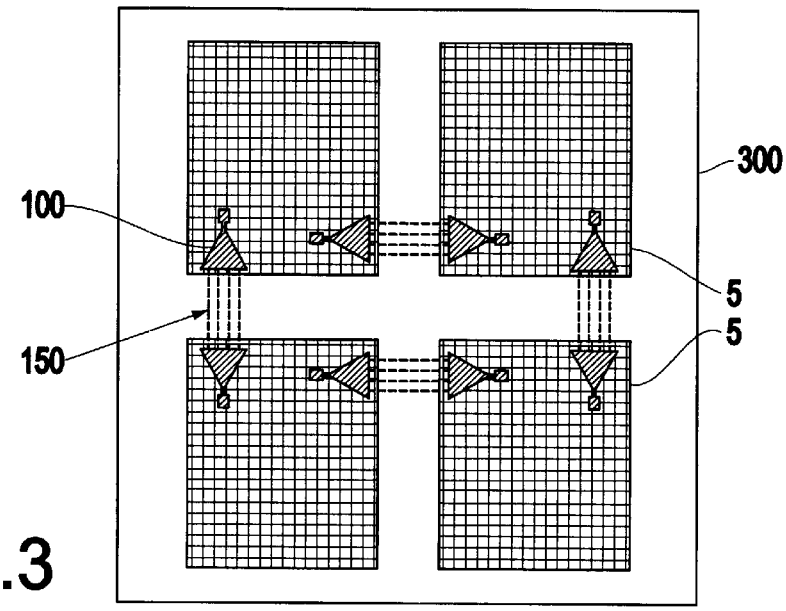
FIG. 3 shows a top view of a module using multiple IC chips with the integrated horn antenna devices used for chip-to-chip data transmissions.

FIG. 3 shows one preferred use of the horn device 100 in a multi-chip module 300. Multi-chip module systems using opto-electronic interconnections are known as taught in Ahmad et al.'s U.S. Pat. N0. 5,818,984 (hereinafter referred to as the '984 patent), which is hereby incorporated by reference.

In the '984 patent, a composite of multiple chips are bonded and electrically connected to wiring on a multilayer ceramic substrate which can then be mounted on and connected to a printed circuit board. This patent discloses a microelectronic module comprising at least two chips mounted to a chip receiving surface. Each IC chip has an edge including at least one chip input and one chip output. The chips are arranged such that the edge of one IC chip is opposite the edge of the other IC chip. Each IC chip includes at least one optical transmitter attached to the edge of the chip. Note that there are no waveguide structures. The transmitter has an input coupled to the chip output and a transmission portion for generating optical signals and that are representative of signals inputted to the transmitter input. Additionally, the '984 patent shows cone shapes that depict the divergence angle of the optical emission from these transmitter outputs, and are not physical waveguide structures. The microelectronic module further includes at least one optical receiver attached to the edge of the chip. The optical receiver has an output coupled to the chip input and a receiving portion for directly receiving optical signals generated by a corresponding optical transmitter of the other chip. The optical receiver and the corresponding optical transmitter form a transmitter and receiver pair. These transmitter/receiver pairs of the '984 patent do not suggest or teach the use of an integrated horn antenna waveguide structure to act as a transmitter/receiver device.

Referring now to FIG. 3, module 300 includes several IC chip substrates 5, each having at least one horn antenna device 100 attached for chip-to-chip signal transmissions (electromagnetic radiation) 150. By use of each device 100, an exemplary chip-to-chip signal transmission frequency can be in the order of 150-GHz range wherein a horn antenna waveguide section 70 that is approximately 3-mm in length. Signals 150 communicated between IC chips 5 using such a module can be multiplexed. IC chips 5 can be "flip-chip" mounted using C4 solder balls, then dielectric waveguides 250 (silicon dioxide, plastic or polymer) or metallized waveguides 250 such as tapered or rectangular segments, or successively larger horns or cones can also be mounted on the module 300 for confining and collecting radiation 150 between corresponding communicating horn antennae 100.

The IC chips on the module 300 can include semiconductor diode lasers, surface-emitting lasers, light-emitting diodes, or electronic oscillator circuits connected to integrated dipole antennae (for example, included in electronic sub-component 40) within the horn waveguide 60 for transmitting electromagnetic signals. Similarly, the chips can include photodetector diodes, or dipole electronics circuits connected to integrated dipole antennae (for example, included in sub-component 40) within the horn waveguide 60 for reception of incoming electromagnetic signals. The horn device 100, because of its small dimensions, is an efficient antenna for transceivers operating with THz oscillators (based on quantum-mechanical tunneling in deep-submicron structures), as well as semiconductor LEDs and lasers. The multi-chip module 300 has applications where multiple chips on a single substrate transmit high frequency signals 150 chip-to-chip using the horn antenna device 100, and optical waveguides 250 on the module in between the horns.

Figure 4:
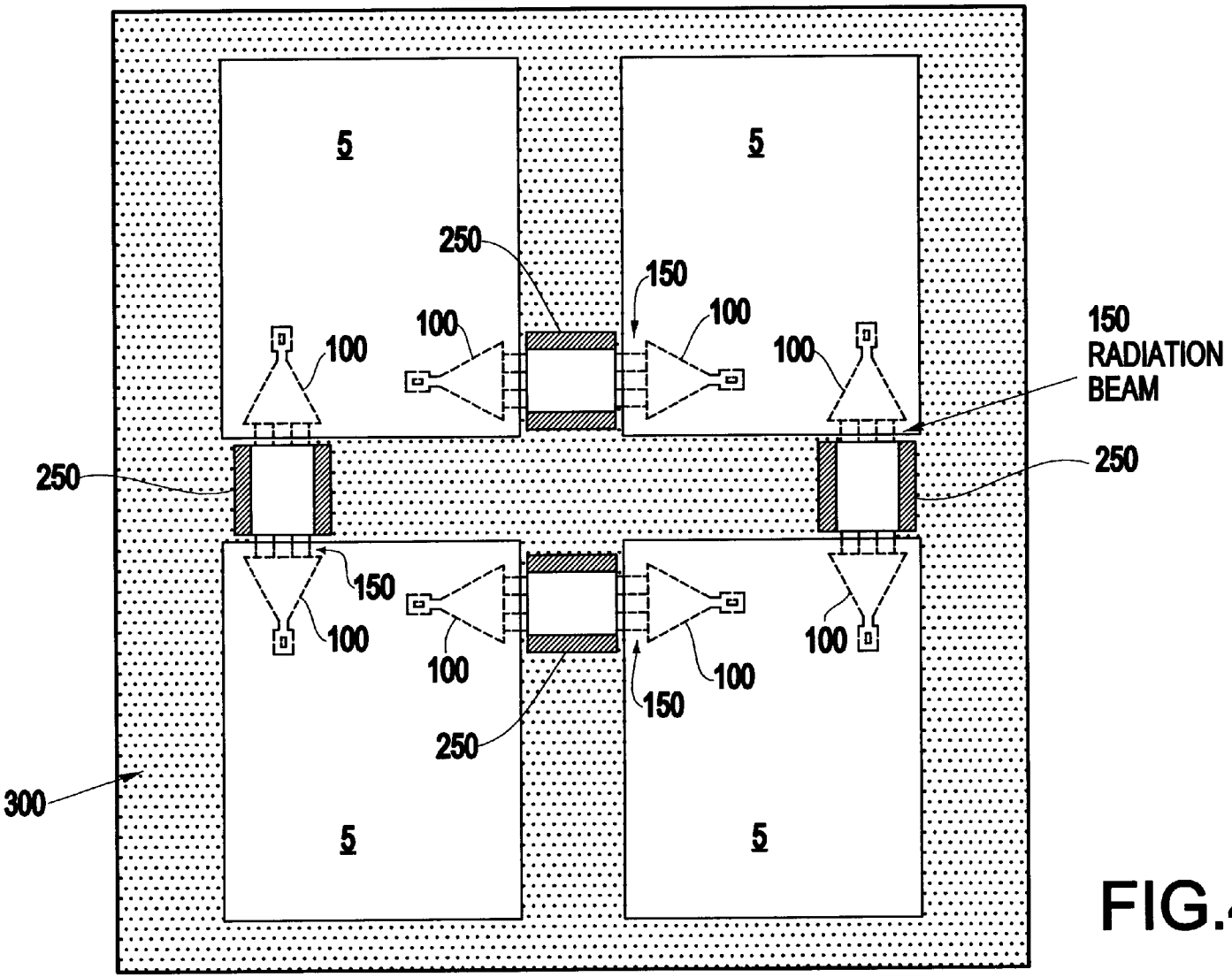
FIG. 4 shows a top view of a module using multiple flip-chip mounted IC chips with the integrated horn antenna devices aligned to additional inter-chip waveguides on the module.

FIG. 4 shows a top view of a module using multiple flip-chip mounted IC chips with the integrated horn antenna devices 100 aligned to additional inter-chip waveguides 250 on the module 300. These additional inter-chip waveguides 250 could be transparent dielectric ridges, fibers, or metallized hollow or dielectric-filled tubes. These waveguides 250 channel radiation 150 more efficiently between pairs of horns to increase signal isolation from neighboring antennae by eliminating any scattered radiation from escaping the beam path.

Figure 5:
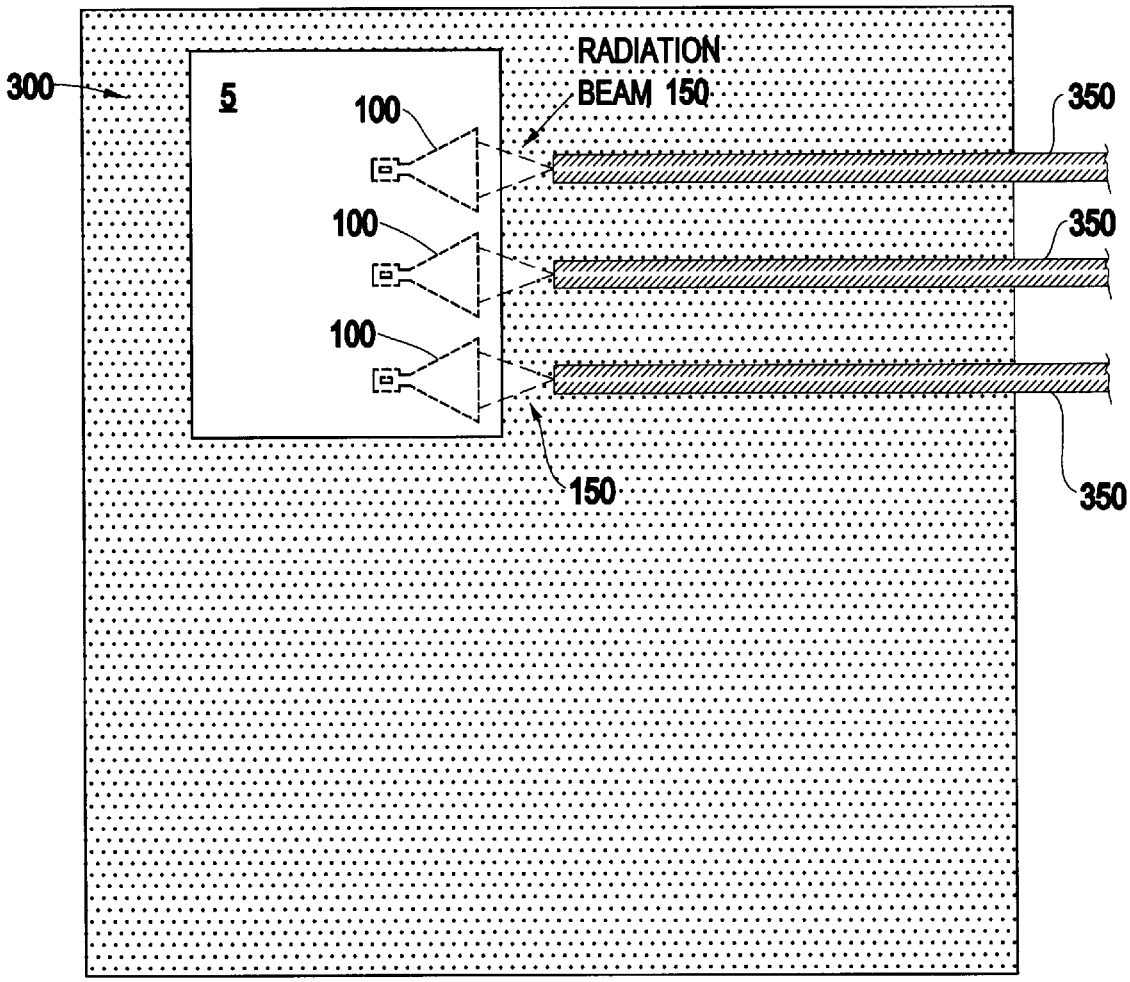
FIG. 5 shows a top view of a module containing an IC chip with the integrated horn antenna devices aligned to additional off-chip waveguides such as optical fibers.

FIG. 5 shows a top view of a module 300 using an IC chip 5 with the integrated horn antenna devices 100 aligned to additional off-chip waveguides 350, in this case several optical fibers 350 mounted in an aligned fashion on the module 300. The horn antennae 100 in this case receive optical output beams 150 from the fibers from a signal source (not shown). The horn shape waveguide device 100 aids in collecting divergent radiation 150 in the beam as shown from the fiber ends, and minimizes problems encountered with the fiber being misaligned with respect to transceiver located on the IC chip 5. This resolves significant problems as to proper optoelectronic alignment of multiple fibers that conventionally require submicron alignment accuracy.

In summary, additional waveguides 250, 350 can be included on the module to redirect, align, collimate, and channel radiation 150 either between said waveguides structures, or between a waveguide and a differing form of a waveguide structure that includes an optical fiber, a larger non-integrated form of an horn or dipole antenna. Use of the integrated horn antenna device 100 with these other forms of waveguide structures 250, 350 provides self-alignment for on-chip optical components for single-mode optical fibers. Use of the invention with these other forms of external waveguide structures 350 allows for light to be funneled to and from the module and minimizing stringent chip alignment requirements between fiber transceiver components that typically must be within fractions of a micron. Without the benefit of the present invention, these other external waveguide structures 350 that usually require micromachined alignment keys, slots, or PZT (piezoelectric force transducer) active adjusters. Advantages of the present invention include increased collection efficiency by collecting over a larger solid angle, and channeling the collected radiation to a small-area sub-component electronic devices 40 where damascene wiring and interconnects are used.

Aditionally, these integrated transmitters 40, receivers 40, and horn antennae 100 allow wireless data communication between chips and from chips to and from the outside environment. This obviates the need for complex, expensive high-performance multilevel interconnects on the package, as well as complex wired impedance-matching structures. The on-chip horn shape 100 relaxes the alignment tolerances needed to couple external waveguides such as single-mode optical fibers 350 or second-stage antennae or rectangular waveguides 250, 350 to the chip. Having such an improvement in the ease of interfacing digital and analogue electronics with optical or wireless signals may be very important and desirable for products such as digital handsets and cellular phones, wireless personal computer interfaces, wireless network adaptors, and the like. In the very high performance computing and switching arena, such devices as are disclosed here could be invaluable for ultrahigh bandwidth digital communications such as are needed for multiprocessor parallel computing and supercomputing systems. The ease of interfacing digital electronic to optical signals, as well as the ease of aligning to single-mode fibers or waveguides, may be important benefits of the present invention for the increasing growth of optical interconnections for digital computing and digital telecommunications applications.

While the invention has been described in terms of preferred embodiments, those skilled in the art will recognize that the invention can be practiced with modification within the spirit and scope of the appended claims.

What is claimed is:

1. A method of producing an integrated circuit structure comprising the steps of:

providing a substrate including an electronic component;

depositing a first insulating layer on said substrate;

patterning said first insulating layer to form first openings for a vertical waveguide portion positioned over said electronic component and a bottom horizontal portion of a horn-shaped waveguide portion, said horn-shaped waveguide portion having an apex positioned over said vertical waveguide portion;

depositing a conductive material in said first openings to form a vertical waveguide structure and a bottom horizontal waveguide structure;

removing excess conductive material from overtop said first insulating layer to form a first planar surface;

depositing a second insulating layer on said first planar surface;

patterning said second insulating layer to form second openings for sidewall portions and a top horizontal portion of said horn-shaped waveguide, said second openings aligned with said bottom horizontal waveguide structure;

depositing said conductive material in said second openings to form an enclosed waveguide cavity comprising material from said second insulating layer; and removing excess conductive material from overtop said second insulating layer.

2. The method in claim 1, wherein said step of patterning said second insulating layer further comprises forming a tapered via, said tapered via positioned at said apex, and said depositing said conductive material in said second openings further comprises depositing said conductive material in said tapered via.

3. The method in claim 2, wherein said step of forming a tapered via comprises a reactive ion etch (RIE) process.

4. The method in claim 2, wherein said tapered via includes a sidewall forming a facet within said enclosed waveguide cavity.

5. A microelectronic module comprising:

a plurality of electronic sub-components formed on a substrate including an insulating layer; and a plurality of waveguides formed in said insulating layer of said substrate above said electronic sub-components, each of said waveguides having a horn-shaped cavity and a linear cavity axially offset from said horn-shaped cavity, wherein said linear cavity is adjacent one of said electronic sub-components, and said horn-shaped cavities are oriented so that said waveguides direct electromagnetic signals between said electronic sub-components.

6. The module of claim 5, wherein said horn-shaped cavity is axially offset from said linear cavity at approximately 90 degrees.

7. The module of claim 5, wherein at least one of said waveguides includes a facet positioned data juncture between said horn-shaped cavity and said linear cavity, wherein said facet redirects electromagnetic energy through said waveguides.

8. The module of claim 5, wherein at least one of said plurality of electronic sub-components comprises a device selected from the group consisting of an electromagnetic receiver device, an electromagnetic transmitter device, an electromagnetic transceiver device, a photo-detector device, a laser, a light-emitting diode and an integrated dipole antenna.

9. The module of claim 5, wherein at least one of said plurality of waveguides is configured to direct radiation to or from an external waveguide structure whereby on-chip self-alignment is enabled without additional components.

10. The module of claim 9, wherein said external waveguide structure comprises an optical fiber.

11. The module of claim 9, wherein said external waveguide structure comprises a horn antenna structure.

12. The module of claim 5, further comprising a plurality of said substrates mounted on said module, wherein at least one of said plurality of waveguides is configured to direct radiation to or from another one of said plurality of waveguides on a different one of said plurality of substrates.

13. The module of claim 12, wherein said module further comprises an inter-chip waveguide configured between a pair of said waveguides formed on different ones of said plurality of substrates so that electromagnetic radiation is directed through said inter-chip waveguide between said pair of waveguides.

* * * * *